United States Patent [19]

Barker

[11] Patent Number: 4,811,442

[45] Date of Patent: Mar. 14, 1989

[54] SWEEPING APPARATUS

[76] Inventor: Ronald E. Barker, 855 E. Skyline, Globe, Ariz. 85501

[21] Appl. No.: 170,845

[22] Filed: Mar. 21, 1988

[51] Int. Cl.[4] ..... E01H 1/05

[52] U.S. Cl. ..... 15/82

[58] Field of Search ..... 15/82–86, 15/79 A, 340

[56] References Cited

U.S. PATENT DOCUMENTS

| | | | |
|---|---|---|---|
| 2,895,150 | 7/1959 | Link, Jr. et al. | 15/83 |
| 3,284,831 | 11/1966 | Larsen | 15/82 |
| 3,444,583 | 5/1969 | Laurel | 15/83 |
| 3,510,900 | 5/1970 | Roslund | 15/82 |

*Primary Examiner*—Edward L. Roberts
*Attorney, Agent, or Firm*—Tod R. Nissle

[57] ABSTRACT

An improved sweeping machine. The machine includes a main frame. A plurality of ground engaging wheels are mounted on the frame. A cylindrical brush is rotatably carried in a support assembly. A pair of elongate linkage members pivotally interconnect the support assembly and the main frame. One of the elongate linkage members is connected to the main frame and brush support assembly at pivot points having a greater elevation than the pivot points of the other linkage member. The sweeping machine of the invention permits the brush to initially rebound away from the ground when the brush begins to rotate.

4 Claims, 2 Drawing Sheets

SWEEPING APPARATUS

This invention relates to machines for sweeping the ground.

More particularly, the invention pertains to a sweeping machine which includes a cylindrical sweeping brush and which minimizes wear of the brush by permitting the brush to rebound away from the ground when the brush initially begins to rotate.

In a further respect, the invention pertains to a sweeping machine in which the cylindrical sweeping brush is positioned forwardly of the machine and is only connected to the machine by upwardly sloped linkage members which pivot on the machine and on the support structure of the brush to generally maintain a constant downward pressure on the brush during the life of the brush.

Sweeping machines are well known in the art. See, for example, U.S. Pat. Nos. 4,643,261 to Long, 4,685,228 to Gisler et al., 1,904,881 to Presbrey, 3,510,900 to Roslund, and 3,071,793 to Lull. In such machines a rotating cylindrical sweeping brush is typically hydraulically maintained at a constant pressure against the ground. Since such prior art apparatus has as its common objective the maintaining of the brush at a constant pressure against the ground, the apparatus does not appear to compensate for the initial "bite" of the brush into ground. This bite occurs when the brush begins to rotate. As the brush increases its speed of rotation from zero to its normal rotation velocity, it bites into the ground and forces the bristles of the brush against the ground with greater than normal force. This initial "bite" of the brush is responsible for a significant portion of the wear of a brush.

While it is desirable for the downward pressure on a brush to remain at an optimal constant level regardless of undulations in the terrain which a brush is traveling over, it is also desirable to reduce the tendency of a brush to bite into the ground when the brush initially begins to rotate.

Accordingly, it would be highly desirable to provide an improved sweeping machine which would significantly reduce the bite of a brush on initial rotation of the brush and which would also tend to maintain the brush against the ground at a relatively constant pressure during movement of the sweeping machine and brush over undulating terrain.

It would also be highly desirable to provide a sweeping machine which would maintain a sweeping brush at relatively constant pressure against the ground without requiring the utilization of hydraulic or electronic apparatus to force the brush against the ground.

Therefore, it is a principal object of the invention to provide improved sweeping apparatus.

Another object of the invention is to provide an improved sweeping machine in which the downward pressure on a brush will remain relatively constant without requiring the utilization of hydraulic pressure acting on the brush.

A further object of the invention is to provide improved sweeping apparatus of the type described in which the sweeping brush is permitted to initially rebound upwardly a short distance when the brush begins to rotate, this rebound offsetting the tendency of the brush to "bite" into the ground and rapidly wear when the brush begins to rotate.

These and other and further and more specific objects and advantages of the invention will be apparent to those skilled in the art from the following detailed description thereof, taken in conjunction with the drawings, in which.

Figure 1:
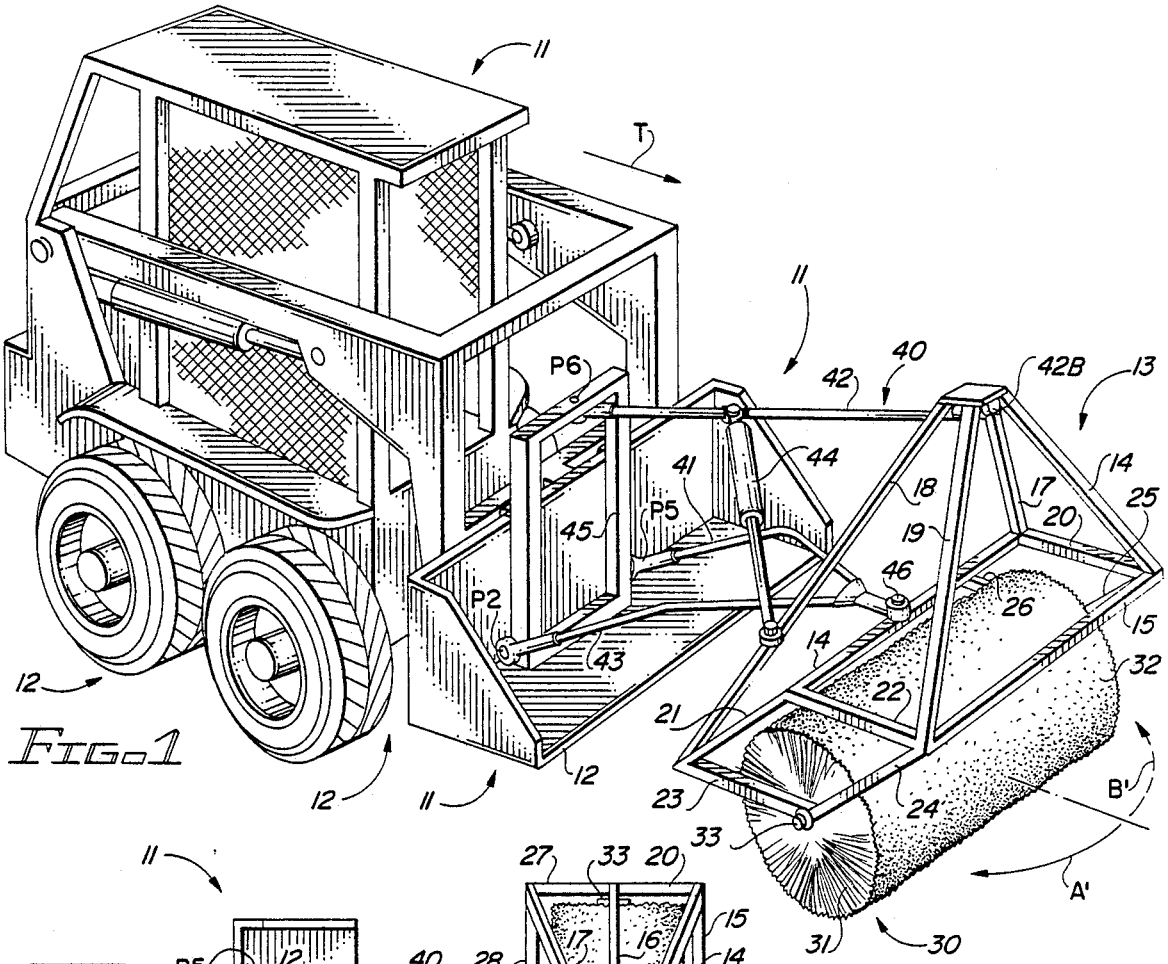
FIG. 1 is a perspective view illustrating a sweeping machine constructed in accordance with the principles of the invention.

Briefly, in accordance with my invention, I provide an improved sweeping machine. The machine includes a frame; a plurality of ground engaging wheels mounted on the frame; motive power means mounted on the frame for turning at least one of the wheels to propel the sweeping machine forwardly over the ground; a support assembly spaced apart from and forward of the frame; a cylindrical brush having a longitudinal axis, first and second ends, and mounted on the support assembly for rotation about the longitudinal axis, the support assembly extending from the first and second ends upwardly to an elevation above the brush; a load bearing linkage framework interconnecting the support assembly and the frame, the linkage framework not interconnecting the sides of the cylindrical brush with the frame and not interconnecting with the frame portions of the support assembly at the sides of the cylindrical brush; and, motor means for rotating the brush, the motor means being carried on at least one of the frame, support assembly and linkage framework. The linkage framework includes a first elongate linkage member extending from the frame upwardly to a primary pivot point on the support assembly, the first linkage member having a first end pivotally attached to the frame and having a second end pivotally attached to the primary pivot point, the primary pivot point having an elevation above the elevation of the cylindrical brush; and, a second elongate linkage member extending from the frame upwardly to the primary pivot point on the assembly, the second linkage member having a first end pivotally attached to the frame and having a second end pivotally attached to the primary pivot point. The first ends of the first and second elongate linkage members are attached to the frame at points laterally displaced from one another. The linkage framework receives substantially all rearward and upward forces generated by the brush during rotation thereof against the ground. The upwardly sloped linkage members are upwardly and rearwardly displaced by rearward forces generated when the cylindrical brush begins to rotate from a stationary position. The brush is forced against the ground by the force of gravity acting on the brush, linkage framework, support framework and the portion of the motor means carried on the support assembly and linkage framework. The slope of the first and second elongate linkage members decreases as the brush wears and the diameter of the brush decreases.

In another embodiment of my invention, I provide an improved sweeping machine which includes a frame; a plurality of ground engaging wheels mounted on the frame; motive power means mounted on the machine for turning at least one of the wheels to propel the sweeping machine forwardly over the ground; a support assembly spaced apart from and forward of the frame; a cylindrical brush having a longitudinal axis, first and second ends, and mounted on the support assembly for rotation about the longitudinal axis, the support assembly extending from the first and second ends upwardly over the brush to an elevation above the brush; a load bearing linkage framework interconnecting the support assembly and the frame, the linkage framework not extending from the side of cylindrical brush to the frame and not extending to the frame from portions of the support assembly at the sides of the cylindrical brush; and, motor means for rotating the brush, the motor means being carried on at least one of said frame, support assembly, and linkage framework. The linkage framework includes a first elongate linkage member extending from the frame upwardly to a primary pivot point on the support assembly, the first linkage member having a first end pivotally attached to the frame and having a second end pivotally attached to the primary pivot point, the primary pivot point having an elevation greater than the elevation of the cylindrical brush; a second elongate linkage member extending from the frame upwardly to the primary pivot point on the support assembly, the second linkage member having a first end pivotally attached to the frame and having a second end pivotally connected to the primary pivot point; and, a third elongate linkage member extending from the frame upwardly to a secondary pivot point on the support assembly, the third elongate linkage member having a first end pivotally attached to the frame and having a second end pivotally connected to the secondary pivot point, the primary and secondary pivot points lying along a common vertical axis. The first ends of the first and second elongate linkage member are attached to the frame at points laterally displaced from one another. The linkage framework bears and transmits to the frame all rearward and upward forces generated by the brush during rotation of the brush against the ground. The upwardly sloped linkage members are upwardly and rearwardly displaced by rearward forces parallel to the ground which are generated when the cylindrical brush begins to rotate from a stationary position. The brush is forced against the ground by the force of gravity acting on the brush, linkage framework, support frame, and the portion of the motor means carried on the support assembly and linkage framework and by the tendency of the brush to bite into the ground on rotation. The upwardly sloped linkage members are downwardly displaced with the primary and secondary pivot points remaining in a common vertical axis when the brush wears and the diameter of the brush decreases.

Figure 2:
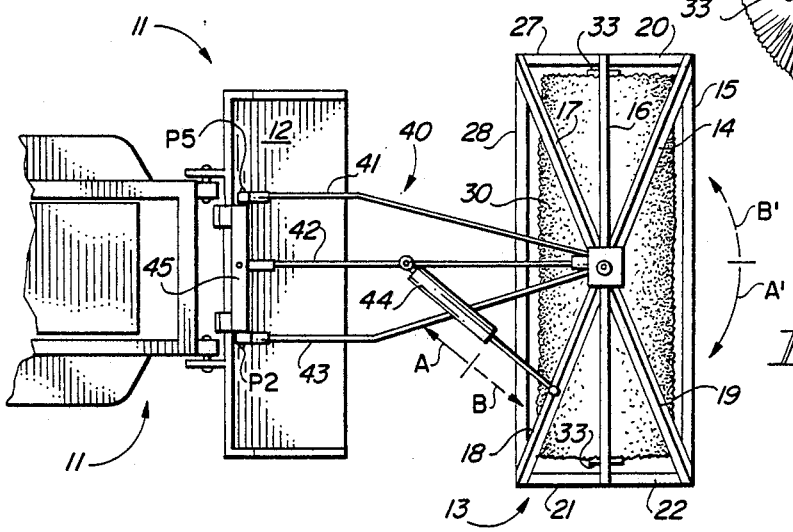
FIG. 2 is a top view of a portion of the sweeping machine of FIG. 1 further illustrating construction details thereof.
Figure 3:
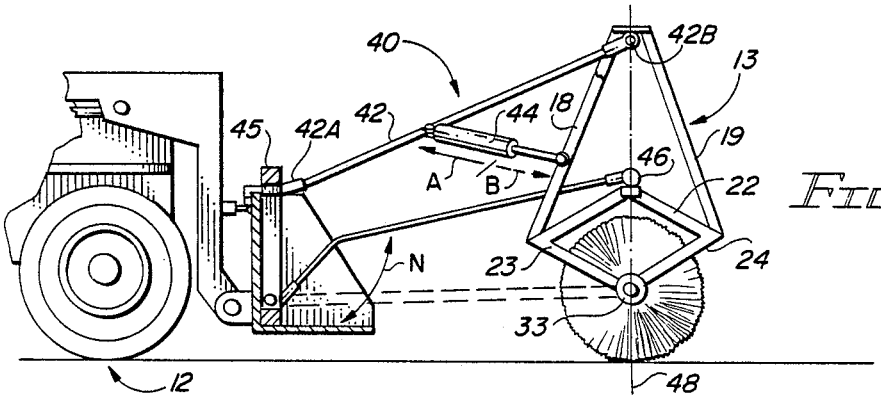
FIG. 3 is a side view of the sweeping machine of FIG. 1 illustrating additional construction details and the mode of operation thereof.

Turning now to the drawings, in which the presently preferred embodiments of the invention are shown for the purpose of illustrating the practice thereof and not by way of limitation of the scope of the invention and in which like reference elements are indicated by corresponding reference characters throughout the several views, FIGS. 1 to 3 illustrate a sweeping machine constructed in accordance with the invention and including a frame 11 and a plurality of ground engaging wheels 12 rotatably mounted on frame 11. Motive power means (not visible) are mounted on the frame 11 for turning at least one of the wheels to propel the sweeping machine forwardly over the ground in the direction of arrow T. Frame 11 includes blade or bucket 12. A support assembly 13 is positioned forwardly and spaced apart from frame 11. Assembly 13 includes elongate structural members 14 to 28. Cylindrical brush 30 is rotatably mounted on the support assembly 30. Brush 30 includes ends 31 and 32 and a longitudinal axis or centerline which is parallel to elongate members 15 and 28 and which passes through the center of brush and is parallel to the cylindrical outer surface of the brush 30. Axles 33 of brush 30 are rotatably attached to assembly 13.

A linkage assembly 40 interconnects support assembly 13 with frame 11. The linkage assembly 40 includes elongate substantially rigid members 41, 42 and 43, hydraulic piston assembly 44, and rectangular frame 45. Frame 45 is fixedly attached to bucket 12. The lower end 42A of member 42 is pivotally attached P6 to frame 45. Upper end 42B of member 42 is pivotally attached to support assembly 13. Similarly, the lower ends of members 41 and 43 are pivotally attached P5, P2 to frame 45. The upper ends of members 41 and 43 are pivotally attached to assembly 13 at point 46. As is shown in FIG. 3, the pivot point of the upper end 42B and the pivot point 46 lie along a common vertical axis 48 which passes through the axle 33 of brush 30. Piston assembly 44 is utilized to turn brush 30 about a vertical axis. When the length of the assembly is shortened in the manner indicated by arrow A in FIG. 2, the brush 30 is turned in the direction indicated by arrow A' in FIGS. 1 and 2. If piston assembly 44 is lengthened in the direction of arrow B in FIG. 2, then brush 30 is turned in the direction of arrow B' in FIGS. 1 and 2.

Figure 4:
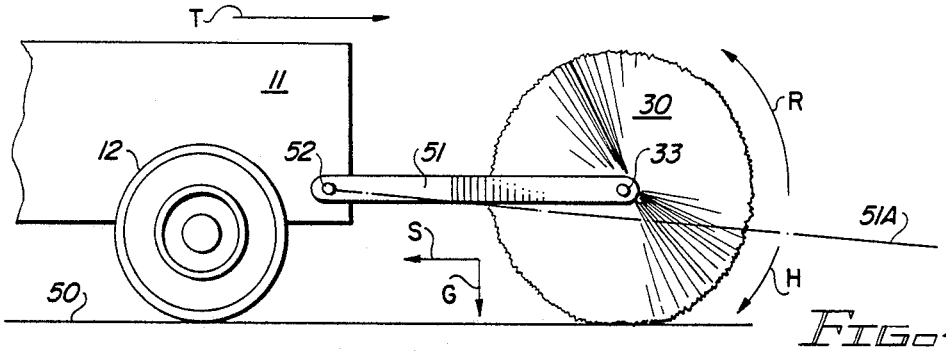
FIG. 4 (PRIOR ART)
FIG. 4 is a side view illustrating operation of prior art devices.
Figure 5:
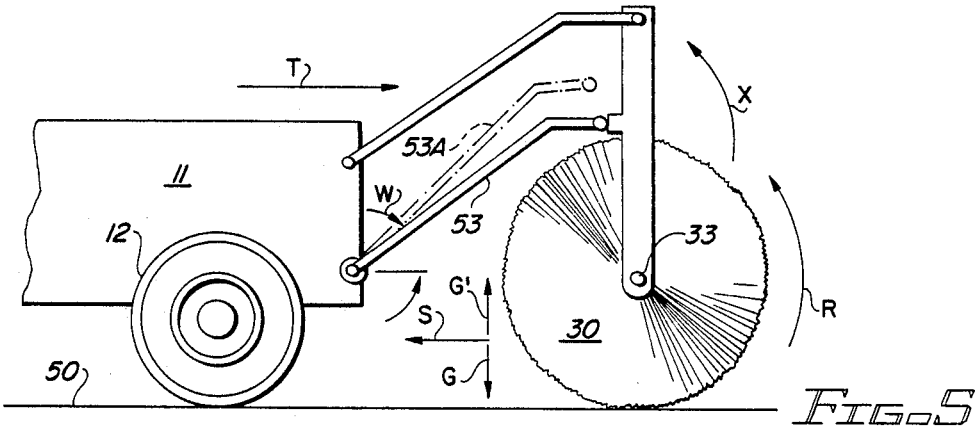
FIG. 5 is a side view illustrating the principle of operation of sweeping machines constructed in accordance with the invention.

One difference between operation of prior art sweeping machines and the sweeping machine of the invention is illustrated in the schematic drawings of FIGS. 4 and 5. As is indicated in FIGS. 4 and 5, a sweeping machine travels in the direction of arrow T, pushing brush 30 across the ground 50. Brush 30 rotates about its longitudinal axis in the direction of arrow R. Motor means (not shown) are provided to rotate brush 30. The motor means can be mounted on frame 11, linkage assembly 40, support assembly 13 and/or brush 30. While brush 30 rotates, frictional forces which resist rotation of brush 30 and movement of brush 30 in the direction of amount generated rearwardly in the direction of arrow S and downwardly in the direction of arrow G. Since brush 30 is normally relatively heavy, the weight of brush 30 is a significant portion of the downward force indicated by arrow G. Further, when brush 30 begins to rotate from a stationary position and the sweeping machine begins to move in the direction of arrow T, brush 30 tends to "bite" or be downwardly pulled or forced into the ground 50. This increases the magnitude of the forces indicated by arrows S and G. When a rigid horizontal linkage arm 51 (FIG. 4) pivotally interconnects the axle 33 and frame 11 of the sweeping machine, arm 51 does not oppose the downward displacement force G. Arm 51 counteracts and resists the rearward force S. When arm 51 is downwardly sloped 51A from pivot point 52, arm 51 facilitates the downward motion of brush 30 toward the ground 50 because force S tends to rotate arm 51 downwardly in the direction indicated by arrow H. In the sweeping machine of the invention, a linkage arm 51 is not used to interconnect brush 30 and frame 11. Instead, a linkage arm 53 is utilized which upwardly slopes from pivot point 52 to a point above brush 30, i.e., to a point which is above pivot pin 52 and the axle 33 of brush 30. This upward sloping of pivot arm 53 causes the rearward force S to generate on arm 53 a force which tends to upwardly displace arm 53 in the direction of arrow X to a secondary position 53A higher than the original position of arm 53. This lifting force G' helps offset the downward displacement or "bite" of brush 30 into ground 50 on start-up and operation of the sweeping machine.

Figure 6A:
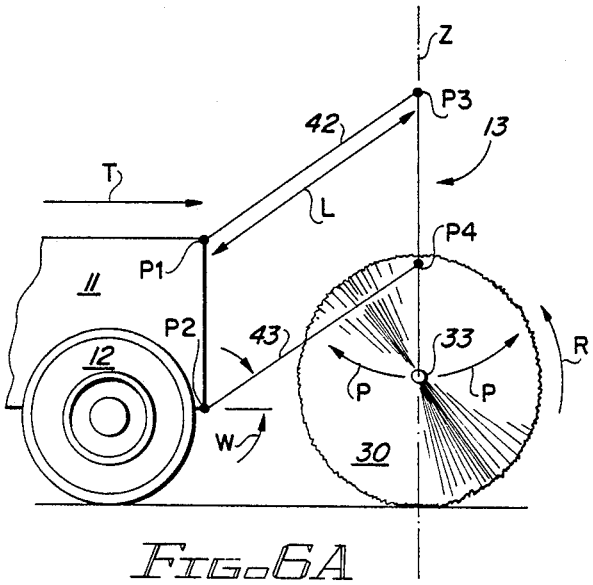
FIG. 6A is a side view further illustrating the principle of operation of the apparatus of FIG. 1; and, FIG. 6B is a side view further illustrating the principle of operation of the apparatus of FIG. 1.
Figure 6B:
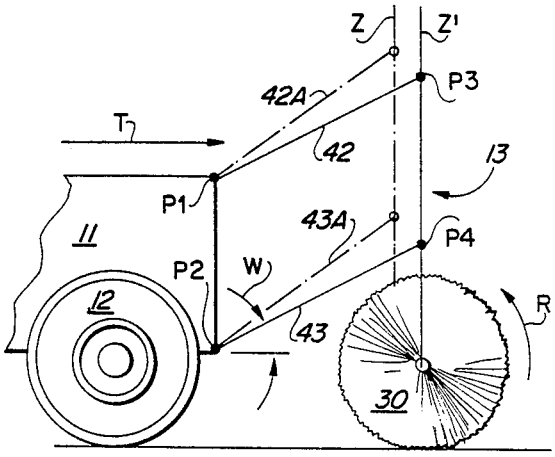

In FIGS. 6A and 6B, linkage arms 42, 43 interconnect frame 11 and brush support assembly 13 at pivot points P. As the brush 30 wears and the outer diameter of brush 30 is reduced, the angle W between arm 43 and the horizontal decreases. As angle 30 decreases, the magnitude of the force G' for a given rearward force S also decreases. This decrease in the magnitude of G' with the diameter of brush 30 is desirable because as the brush size decreases the weight and the velocity of the periphery of the brush also decrease. In FIG. 6B, dashed lines 42A and 43A indicated the positions of arms 42 and 43 as illustrated in FIG. 6A and, accordingly, indicate the positions of arms 42 and 43 when the diameter of brush 30 is the diameter indicated in FIG. 6A. The diameter of brush 30 in FIG. 6A is greater than the diameter of brush 30 in FIG. 6B.

A hydraulic shock absorber, indicated by arrows N in FIG. 3, can interconnect frame 11 and a linkage arm 41–43 and minimize any tendancy of brush 30 to bounce upwardly away from the ground. The purpose of shock absorber N is, as noted, to absorb upward deflections of brush 30 away from the ground. Absorber 30 is not intended to pull or force brush 30 against the ground 50.

In FIG. 6A, pivot points P3 and P4 lie along a common vertical axis Z. As the size of brush 30 decreases and arms 42 and 43 move downwardly the axis Z moves forwardly in the manner indicated in FIG. 6B. In FIG. 6B axis Z has moved from its position in FIG. 6A to a new position designated by Z'. The spatial relationship of pivot points P3 and P4 remains the same as axis Z moves laterally in the manner indicated in FIGS. 6A and 6B. Since arms 42 and 43 are connected to support assembly 13 at points above brush 30, i.e., at points above pivot point P1 and P2, respectively, and above the longitudinal axis of brush 30, pivot points P3 and P4 must be stacked one above the other to prevent brush 30 and support assembly 13 from angling away from the vertical axis Z in the manner indicated by arrows P. Similarly, as shown in FIGS. 1 and 2, the pivot points P2 and P5 are laterally spaced apart to prevent the unwanted rotation of assembly 13 and brush 30 about a vertical axis. The rotation of brush 30 and assembly 13 about a vertical axis is instead controlled by piston assembly 44 in the manner earlier described. Axes A and Z' are parallel.

A principal advantage of the invention is that utilization of the linkage assembly of the invention in the manner described to connect the support assembly 13 to frame 11 provides a "floating" brush which operates under its own weight and the weight of assembly 13, assembly 40, and of any motor means carried on assemblies 13 or 40. Hydraulic or electronic systems do not have to be utilized to force the brush 30 against the ground. Excessive downward rearward forces S automatically generate upward forces G' which offset forces S and G (FIG. 5) and extend the operational life of the brush. The upward slope of arms 41 to 43, attachment of the arms to assembly 13 at points above brush 30, and the pivot point P combination utilized are each crucial to proper functioning of the sweeping machine of the invention.

In operation of the sweeping machine of the invention, motor means mounted on the machine are activated to rotate brush 30 in the direction of arrow R and motive power means carried on frame 11 are activated to propel the machine at a desired speed in a forward direction of travel T. As brush 30 continues to rotate at a selected RPM, the weight of brush 30 decreases and the angular velocity of a point on the cylindrical periphery of brush 30 decreases. The rotations per minute (RPM) of the brush normally remains constant. As the brush 30 wears and its diameter decreases, the magnitude of upward force G' decreases. As brush 30 wears and its diameter decreases the force G of the brush against the ground remains the same or alters at a slower than normal pace because of the concomitant decrease in upward force G'. The decrease in the angle of arms 41, 43 and 42 from the horizontal causes the magnitude G' for a particular rearward force to decrease. The weight of brush 30, assemblies 13 and 40, of motor means and other weight carried on assemblies 13 and 14, and the length L and slope of each linkage arm 41 to 43 are preferably adjusted such that the force G of brush 30 against the ground stays the same or substantially the same as brush 30 wears and its diameter decreases.

In FIG. 6A the distance between points P1 and P2 is equivalent to the distance between points P3 and P4. When these two distances are equal, axis Z (FIG. 6B) will, as would be appreciated by those of skill in the art, be parallel to axis Z'. If the shortest distance between points P1 and P2 is not equal to the shortest distance between points P3 and P4, then axis Z will be at an angle to axis Z' and will not be parallel to axis Z'.

When bucket 12 (FIG. 2) is raised, the pivot points P2 and P5 are raised, causing arms 41 and 43 to become more nearly horizontal. Consequently, raising bucket 12 reduces the slope of arms 41 to 43 and decreases the magnitude of force G' in FIG. 5. Lowering bucket 12 from a selected position increases the slope of arms 41 to 43 and increases the magnitude of force G' for a brush rotating at a selected speed.

Frame 45 is adapted to be readily attached to and removed from bucket 12.

Having described my invention in such terms as to enable those skilled in the art to understand and practice it, and having identified the presently preferred embodiments thereof, I claim:

1. A sweeping machine including (a) a frame;

(b) a plurality of ground engaging wheels mounted on said frame;

(c) motive power means mounted on said frame for turning at least one of said wheels to propel said sweeping machine forwardly over the ground;

(d) a support assembly spaced apart from and forward of said frame;

(e) a cylindrical brush having a longitudinal axis, first and second ends, and mounted on said support assembly for rotation about said longitudinal axis, said support assembly extending from said first and second ends upwardly to an elevation above said brush;

(f) a sloped load bearing linkage framework interconnecting said support assembly and said frame, said linkage framework being attached to said support assembly at points elevated above said brush and including (i) a first elongate linkage member extending from said frame upwardly to said support assembly, said first linkage member having a first end pivotally attached to said frame and having a second end pivotally attached to said support assembly, said second end being above said cylindrical brush, (ii) a second elongate linkage member extending from said frame upwardly to said support assembly, said second linkage member having a first end pivotally attached to said frame and having a second end pivotally attached to said support assembly;

(g) motor means for rotating said brush, said motor means being carried on at least one of said frame, support assembly and linkage framework;

said first ends of said first and second elongate linkage members being attached to said frame at points having differing elevations;

said second ends of said first and second elongate linkage members being attached to said support assembly at points having differing elevations;

said linkage framework receiving rearward and upward forces generated by said brush during rotation thereof against the ground;

said slope of said first and second elongate linkage members decreasing as said brush wears and the diameter of said brush decreases;

rearward force generated by said brush during rotation thereof producing an upward force acting on said sloped linkage members and opposing the force generated by gravity acting on said brush;

said brush upwardly moving in a direction away from the ground when said cylindrical brush begins to rotate from a stationary position on the ground; and said brush being forced against the ground when said machine and brush are stationary, solely by the force of gravity acting on said brush, linkage framework, support assembly, and the portion of said motor means carried on said support assembly and linkage framework, and when said machine is stationary and said brush is rotating, by the force of gravity acting on said brush, linkage framework, support assembly, and on the portion of said motor means carried on said support assembly and linkage framework and by downward forces generated by interaction of the rotating brush and the ground.

2. The sweeping machine of claim 1 including means for altering the elevation of said first ends above the ground to alter the slope of said linkage members.

3. A sweeping machine including (a) a frame;

(b) a plurality of ground engaging wheels mounted on said frame;

(c) motive power means mounted on said frame for turning at least one of said wheels to propel said sweeping machine forwardly over the ground;

(d) a support assembly spaced apart from and forward of said frame;

(e) a cylindrical brush having a longitudinal axis, first and second ends, and mounted on said support assembly for rotation about said longitudinal axis, said support assembly extending from said first and second ends upwardly over said brush to an elevation above said brush;

(f) a sloped load-bearing linkage framework interconnecting said support assembly and said frame, said linkage framework attached to said support assembly at points elevated above said brush and including (i) a first elongate linkage member extending from said frame upwardly to said support assembly, said first linkage member having a first end pivotally attached to said frame and having a second end pivotally attached to said support assembly, said second end being above said cylindrical brush, (ii) a second elongate linkage member extending from said frame upwardly to said support assembly, said second linkage member having a first end pivotally attached to said frame and having a second end pivotally connected to said support assembly, (iii) a third elongate linkage member extending from said frame upwardly to said support assembly, said third elongate linkage member having a first end pivotally attached to said frame and having a second end pivotally connected to said support assembly, said pivot connection of said second end of said third elongate member being at a greater elevation than said pivot connections of said second ends of said first and second members, said first end of said third member being at an elevation greater than said first ends of said first and second members;

(g) motor means for rotating said brush, said motor means being carried on at least one of said frame, support assembly and linkage framework;

said first end of said first and second elongate linkage members being attached to said frame at points laterally displaced from one another;

said linkage framework receiving rearward and upward forces generated by said brush during rotation thereof against the ground;

a rearward force generated by said brush during rotation thereof producing an upward force acting on said sloped linkage members and opposing the force generated by gravity acting on said brush;

said brush upwardly moving in a direction away from said ground when said cylindrical brush begins to rotate from a stationary position on the ground;

said brush being forced against the ground when said machine and brush are stationary solely be the force of gravity acting on said brush, linkage framework, support assembly, and the portion of said motor means carried on said support assembly and linkage framework, and when said machine is stationary and said brush is rotating by the force of gravity acting on said brush, linkage framework, support assembly, and on the portion of said motor means carried on said support assembly and linkage framework and by any downward forces generated by interaction of the rotating brush and the ground.

4. The sweeping machine of claim 3 including means for altering the elevation of said first ends above the ground to alter the slope of said linkage members.

* * * * *